US005403365A

United States Patent [19]

Merriam et al.

[11] Patent Number: 5,403,365

[45] Date of Patent: Apr. 4, 1995

[54] PROCESS FOR LOW MERCURY COAL

[75] Inventors: Norman W. Merriam; R. William Grimes; Robert E. Tweed, all of Laramie, Wyo.

[73] Assignee: Western Research Institute, Laramie, Wyo.

[21] Appl. No.: 54,922

[22] Filed: Apr. 30, 1993

[51] Int. Cl.[6] ..... C10L 5/00

[52] U.S. Cl. ..... 44/621; 44/626; 423/107; 423/210; 423/461; 95/134

[58] Field of Search ..... 44/621, 622, 626; 423/107, 210, 461; 55/72, 74; 201/17, 41

[56] References Cited

U.S. PATENT DOCUMENTS

| | | | |
|---|---|---|---|
| 3,876,393 | 4/1975 | Kasai et al. | 55/68 |
| 4,101,631 | 7/1978 | Ambrosini et al. | 423/210 |
| 4,477,257 | 10/1984 | Koppelman et al. | 44/636 |
| 4,491,609 | 1/1985 | Degel et al. | 427/215 |
| 4,892,567 | 1/1990 | Yan | 55/33 |
| 4,986,898 | 1/1991 | Nisimura et al. | 208/251 R |

OTHER PUBLICATIONS

Brown & Schmidt, "Characterization of Hazardous Air Pollutants from Coal-Fired Electric Utilities," ACS National Meeting, Denver, Mar. 1993.

Otani et al, "Adsorption of Mercury Vapor on Particles," 20 Environmental Science Technology, 735, 1986 (no month).

*Primary Examiner*—John Niebling
*Assistant Examiner*—Edna Wong
*Attorney, Agent, or Firm*—John O. Mingle

[57] ABSTRACT

A process for producing low mercury coal during precombustion procedures by releasing mercury through discriminating mild heating that minimizes other burdensome constituents. Said mercury is recovered from the overhead gases by selective removal.

6 Claims, 2 Drawing Sheets

PROCESS FOR LOW MERCURY COAL

This invention was made with Government support under DE-FC21-93MC30126 awarded by the Department of Energy. The Government has certain rights in this invention.

BACKGROUND OF INVENTION

1. Field of Invention

The present invention relates to selectively processing coal to remove and environmentally stabilize a substantial fraction of the mercury.

2. Background

The upgrading processing of coal can take a number of forms such as drying, pyrolysis and mild gasification. However in so processing little concern has been shown for where the heavy elements of environmental concern, in particular mercury, actually are deposited. Often during power plant operation they are conjectured to leave with the stack gases or remain in the ash. Sometimes the upgrading processing is alleged to remove them.

Recent governmental laws and regulations require an evaluation of the emissions of hazardous air pollutants, such as airborne mercury. Several studies, mandated by law, are scheduled for the near future and among these are evaluations of mercury emissions on human health and the environment. Therefore, the ability to reduce mercury emissions will be paramount in the near future. In the long range future all mercury releases of any manner may become a concern.

One study showed that mercury from coal ended up primarily in the flue gases; Brown and Schmidt, "Characterization of Hazardous Air Pollutants from Coal-Fired Electric Utilities," ACS National Meeting, Denver, March 1993, hereinafter Brown (1993). When coal is preprocessed before being sent to utilities such as has been proposed for low-sulfur Western coals, the study is likely unapplicable since mercury is removed unknowingly during processing.

The processing of coal, especially Western coal, for power plants starts with drying. Coal is dried for a variety of reasons, such as to save on transportation costs, to increase the heating value, to increase the net dollar value, to prevent handling problems caused by freezing weather, to improve coal quality particularly when used for coking, briquetting, and producing chemicals, to improve operating efficiency and reduce maintenance of boilers, and to increase coke oven capacity. However drying of coal causes increased dust formation as the dry coal is more friable. Further readsorption of moisture of dried coals is often considered a potential problem. In all this processing where the mercury originally present in mined coal becomes deposited is unknown.

The general problem of coal drying represents removing three types of moisture: free, physically bound, and chemically bound. Free moisture is found in the very large pores and interstitial spaces of coal and often is removed by mechanical means as it exhibits the normal vapor pressure expected of water at that temperature.

Physically bound moisture is more difficult to remove as it is held tightly in small coal capillaries and pores. Because of this, its vapor pressure and specific heat are reduced over that expected of free moisture.

Chemically bound moisture is characterized by a bonding between surfaces and water. Monolayer and multilayer bonding are commonly identified.

Sometimes a fourth type of moisture is identified which comes from the decomposition of organic compounds. It is really not moisture held in coal but is produced during coal decomposition.

Coal drying is characterized by typical drying curves that exhibit distinct rate regions. Firstly, a transient region occurs as equilibrium conditions are sought while the material heats. This is followed by a largely constant rate portion of drying where the material temperature is relatively constant during the unbound moisture removal, and the drying rate is generally determined from only the particle size and moisture content, be it coal or some other material.

The final region is a period of decreasing rate as the material temperature increases and the physically and chemically bound moisture is removed. For this drying regime the particle size, temperature, and residence time are important parameters. Often the drying rate becomes diffusion controlled, and since diffusivity increases with temperature, higher temperatures are employed to continue drying the materials.

During the constant rate period, the heat and mass transfer rates are directly proportional to the driving forces of temperature gradient and humidity gradient respectively; the appropriate proportionality constants, however, are usually experimentally determined. Maintaining large values of said gradients become important when efficient drying equipment is designed; however, if drying residence time is increased easily, such gradients become less important. On the other hand when the concern is vaporization of mercury metal, temperature gradients can also effect its rate.

For many coals with higher moisture content, the most important variable is often the degree of fines produced for higher velocity drying gases entrain more such fines.

Equipment to control particulate emissions, especially from fluidized bed dryers, includes combinations of cyclones, electrostatic precipitators, bag filters, and wet scrubbers. Cyclones are ineffective with particle sizes below five microns, so their operation is usually restricted to extraction of large particle dust loading prior to removal of fine dust particles by subsequent equipment. However cyclones employed at the gas stream dew point or with water-spraying, are nearly as effective as wet scrubbers. Electrostatic precipitators operate free of condensation, and in addition, are subject to malfunctions and frequent maintenance. When superimposing the mercury problem on this equipment, consideration of whether mercury in some vapor form is adsorbed, or maybe absorbed, onto coal particle dust fines. One study has shown that mercury vapor not associated with dust particles generally passes through filters and electrostatic precipitators; see Brown (1993). Another study concludes that most mercury behaves as a vapor even in the presence of particulate matter; see Otani et al., "Adsorption of Mercury Vapor on Particles," 20 Environmental Science Technology, 735, 1986.

Often such dust after collection is returned to the processed coal in some manner. Under this circumstance mercury present with such fines would have been rearranged but not removed. Sometimes such fines are burned for the energy requirements of the process, and in this case, any mercury might end up in ash or stack gases. In general it will remain in the locality of the coal drying operation in contrast to the power plant region. Of course during mine upgrading processing, some unvaporized mercury remains in the processed coal and is transported to the power plant location.

At temperatures higher than that employed for drying, pyrolysis of coal occurs, and this takes many forms often concentrating on the various products of mild gas, hydrocarbon liquids and solid char. Whereas previously much pyrolysis design stressed obtaining maximum yields of liquid and gaseous products, modern operations now concentrate upon well-controlled partial pyrolysis designed to produce selected outputs that are recycled within the process to make the final processed coal product.

Prior art United States patents covering the above mentioned coal processing to isolate mercury include:

| U.S. Pat. No. | Inventor | Year |
|---|---|---|
| 3,876,393 | Kasai et al | 1975 |
| 4,101,631 | Ambrosini et al | 1978 |
| 4,491,609 | Degel et al | 1985 |
| 4,892,567 | Yan | 1990 |
| 4,986,898 | Nisimura et al | 1991 |

Referring to the above list, Kasai et al disclose removing mercury from gases by employing activated carbon impregnated with sulfuric acid solution. Ambrosini et al disclose removing mercury vapor from gas streams by using crystalline zeolitic molecular sieves. Degel et al disclose producing carbonaceous adsorbents impregnated with elementary sulfur. Yan discloses simultaneously removing mercury and water with molecular sieves comprising silver or gold on zeolite. Nisimura et al disclose removing mercury from hydrocarbon oil special treating agent comprising some metals or their selected inorganic compounds.

SUMMARY OF INVENTION

The objectives of the present invention include overcoming the above-apparent deficiencies in the prior art by providing a process that isolates mercury removal from coal and overhead gases resulting from coal processing, and in addition, provides a low cost, high percentage method.

DETAILED DESCRIPTION OF INVENTION

Figure 1:
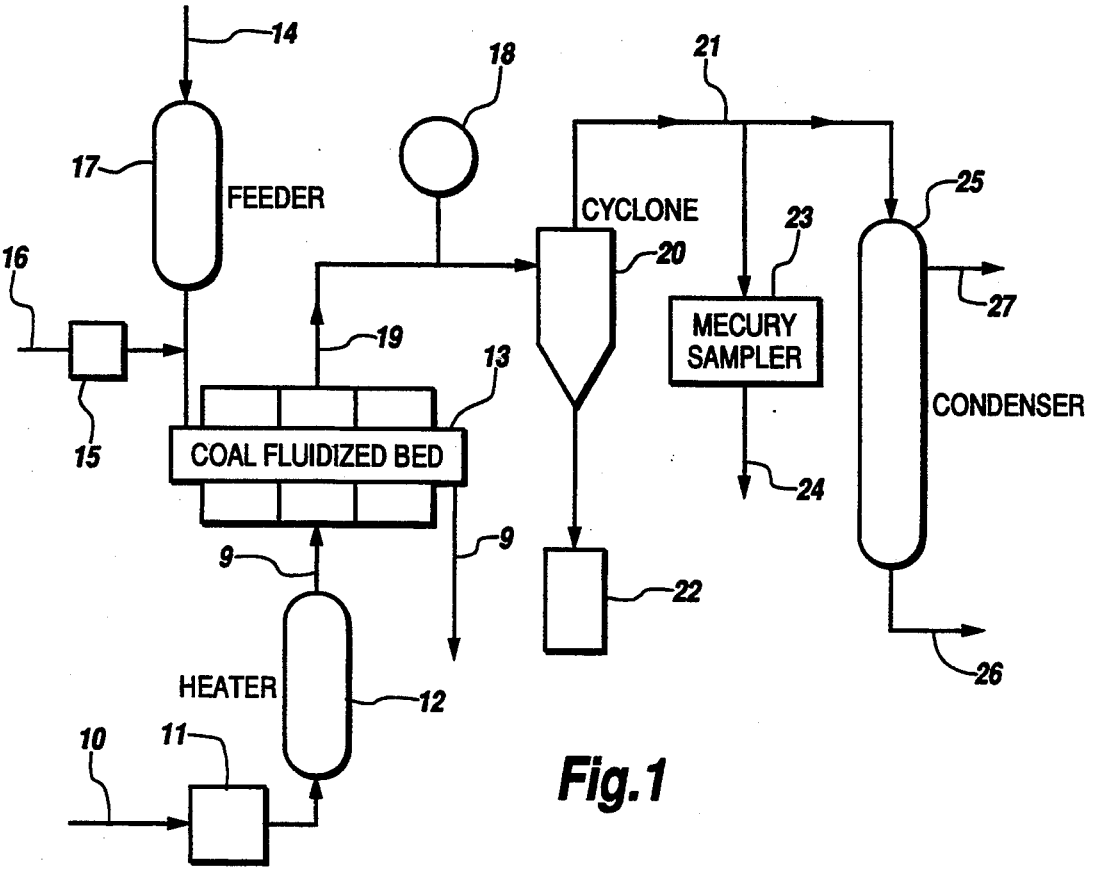
FIG. 1 shows an experimental mercury release process during drying of low-rank coal.
Figure 2:
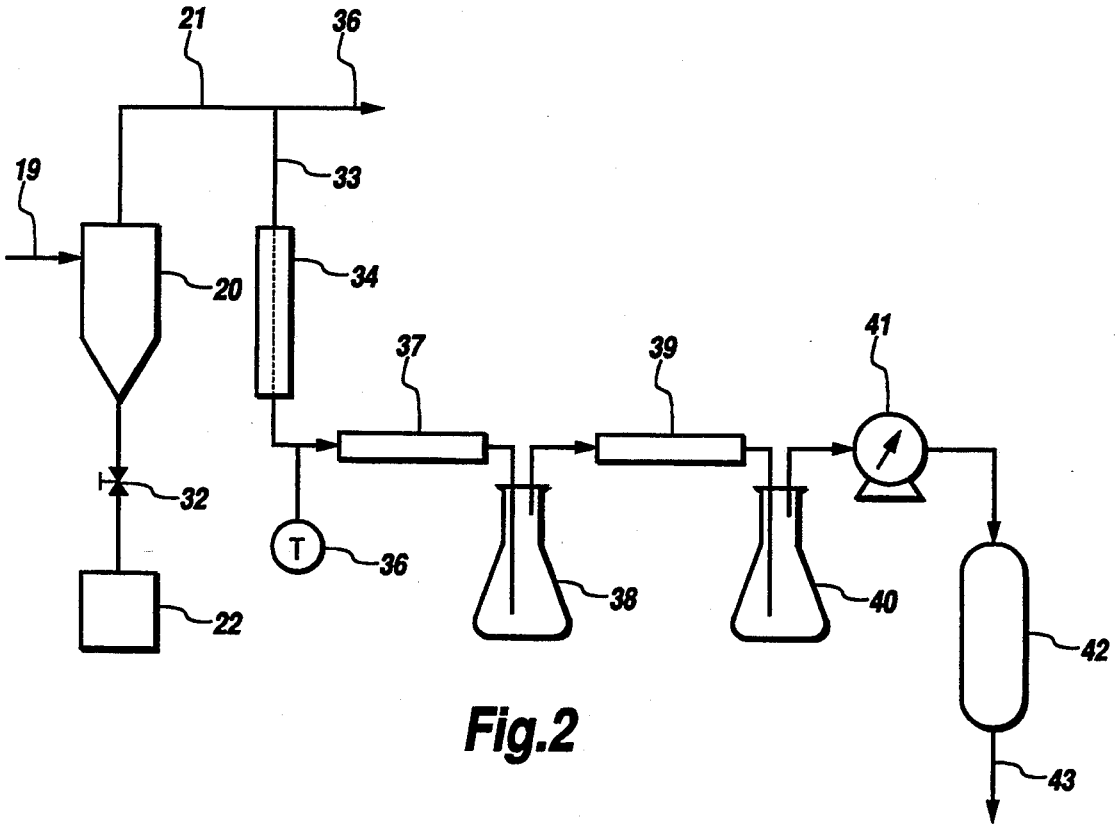
FIG. 2 shows a laboratory testing procedure for mercury.
Figure 3:
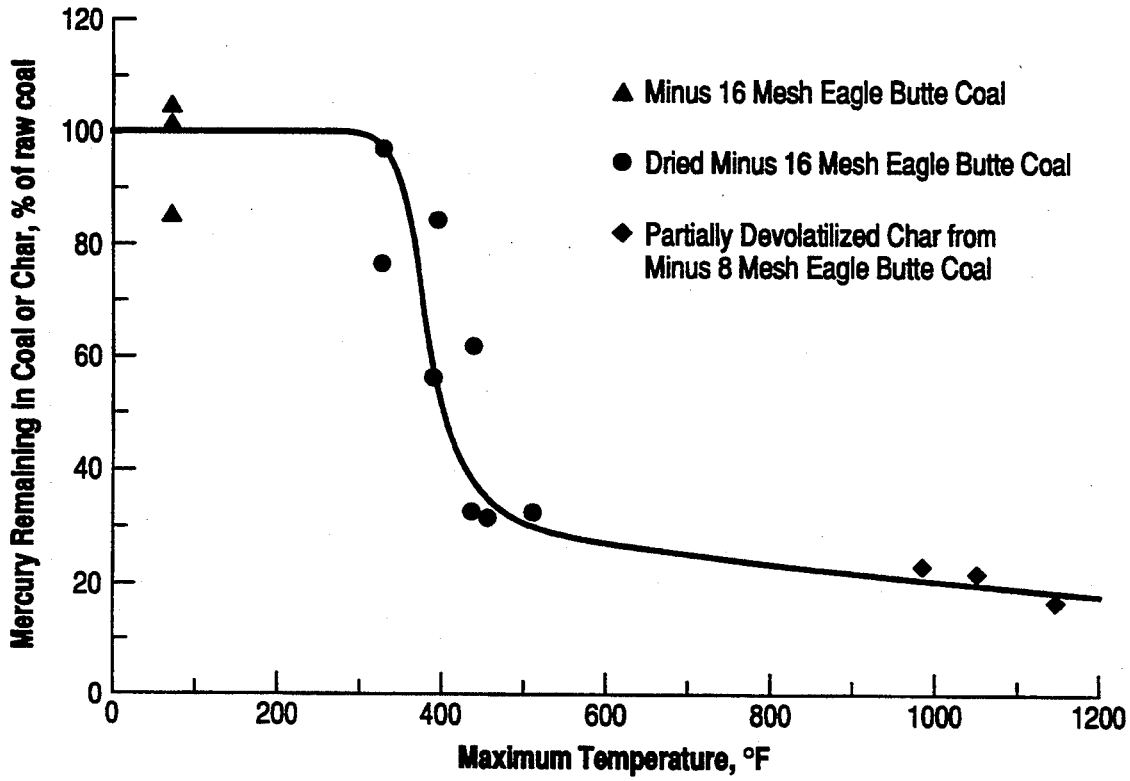
FIG. 3 shows the release of mercury from typical Western coal.

The flow sheet of FIG. 1 shows a bench scale testing unit for determining the mercury at various times during the processing of coal. The crushed raw coal 14 enters through a lock-hopper 17 with some purge gas 16 metered 15 into a Inclined Fluidized Bed 13 operated in a horizonal position that contains thermocouples to measure the maximum bed temperature. The fluidizing gas 9 is carbon dioxide 10 metered 11 and heated 12. The overhead gas 19 is temperature measured 18 and enters a cyclone system 20 to remove and collect 22 fines. The gas 21 passing through the cyclone is sampled with a gas sampler 23 fed with a vacuum line 24. FIG. 2 shows more detail of this gas sampling system. The gas stream 21 enters a condenser system 25 collecting water 26 and venting 27 residual gas. During operation the coal is dried and pyrolyzed as the temperature rises and the resulting experimental mercury amounts are shown in FIG. 3.

EXAMPLE 1

Samples of Powder River Coal from the Eagle Butte mine were analyzed for mercury content along with samples of char obtained after pyrolysis of similar coal. FIG. 2 shows the sampling system setup to trap the mercury in activated carbon before employing the cold vapor atomic adsorption spectroscopy procedure of ASTM D3684. In employing this procedure particular care was needed to insure that mercury overloading of activated charcoal traps did not occur and that unwanted condensation of mercury did not occur in lines and equipment. Referring to FIG. 2, exit dryer gas 19 enters a cyclone 20 which removes and stores fines 22 through a gas seal 32. The overhead 21 of the cyclone 20 passes 35 for further processing but is sampled 33 through a heater 34 and its temperature measured 36. It then passes into a activated carbon trap 37 which removes the mercury. A liquid trap 38, a cooler 39, and a second liquid trap 40 preceded a gas meter 41 and a vacuum system 42 before venting 43.

In this mercury sampling for the coal system of FIG. 1, the feed coal, fines, dried coal, and activated carbon traps were analyzed for mercury using ASTM D3684. Water was analyzed for mercury using EPA 7470.

The results indicated that mercury in raw coal of minus 16 mesh varied from five to eleven lb of Hg per $10^{12}$ Btu, equivalent to approximately 0.04 to 0.1 ppm for this Eagle Butte coal. This compares favorably with reported results of 0.01 to 8 ppm for U.S. coals; see Chow et al., "Managing Hazardous Air Pollutants," presented at Canadian Electrical Assoc. Meeting, Vancouver, B.C., March 1992; hereinafter Chow (1992). Of this original mercury in coal tests showed that approximately 20 percent remained in the char of minus 8 mesh after high temperature pyrolysis. Thus about 80 percent was removed in the overhead vapor stream for this Powder River Coal.

Conversely Chow (1992) reports that regardless of the total amount of mercury initially present in the raw coal, after combustion the ash contains amounts from 0.01–0.025 ppm. This indicates that high mercury coals have a greater percent of potentially volatile mercury. The above measurements on Powder River Coal fall in this range.

EXAMPLE 2

In order to dry and pyrolyze coal, it was necessary first to investigate its characteristics in order to determine the necessary temperature settings for the fluidized bed operations. Tests on typical coals employed in these drying operations are well summarized in U.S. Pat. No. 5,087,269; hereinafter Patent '269 whose specification hereby is incorporated by reference.

These conversion studies indicate that significant pyrolysis conversion started at near 475° F. with predominately carbon dioxide formed as the gaseous product below 750° F.; however, as the carbon dioxide formed, these pyrolysis reactions did also produce considerable liquid tar. For large amounts of vapor tar-like pitch to form, pyrolysis temperatures in the range of about 900°-1000° F. were needed.

From the above information the preferred embodiment operating conditions were to keep the bed temperature below 400° F. for only drying, and this was potentially as low as 140° F. depending upon the fines produced; however, a temperature of about 250° F. produced the evolution of moisture without allowing any significant pyrolysis to occur.

The next step introduced rapid heating which produced pyrolysis and did evolve carbon dioxide, tar, and various hydrocarbons; for this the best operating condition was near about 950° F. with a range of from about 600°-1100° F.

EXAMPLE 3

The procedure of Example 1 was utilized in a modified form to measure the amount of mercury leaving the subject coal during its heating through the drying region and the pyrolysis region. FIG. 3 gave the results obtained and indicated that when the range of temperatures traversed about 300°-550° F., a substantial fraction of mercury removal occurred through vaporization, approximately 70 to 80 percent of the original mercury as determined in Example 1.

The process of Patent '269 represented drying western coal using a drying temperature up to 482° F. (250° C.) implying that the mercury was largely removed in the drying process. The next temperature regime was employed to primarily obtain carbon dioxide which in Patent '269 was the recycled drying and pyrolysis fluidizing gas. However Patent '269 also showed that at a coal bed temperature of 250°-300° F., drying was essentially completed. Thus limiting coal drying to about 300° F. will produce good drying to near zero moisture content and still retain substantially all of the mercury in the dried coal.

EXAMPLE 4

Figure 4:
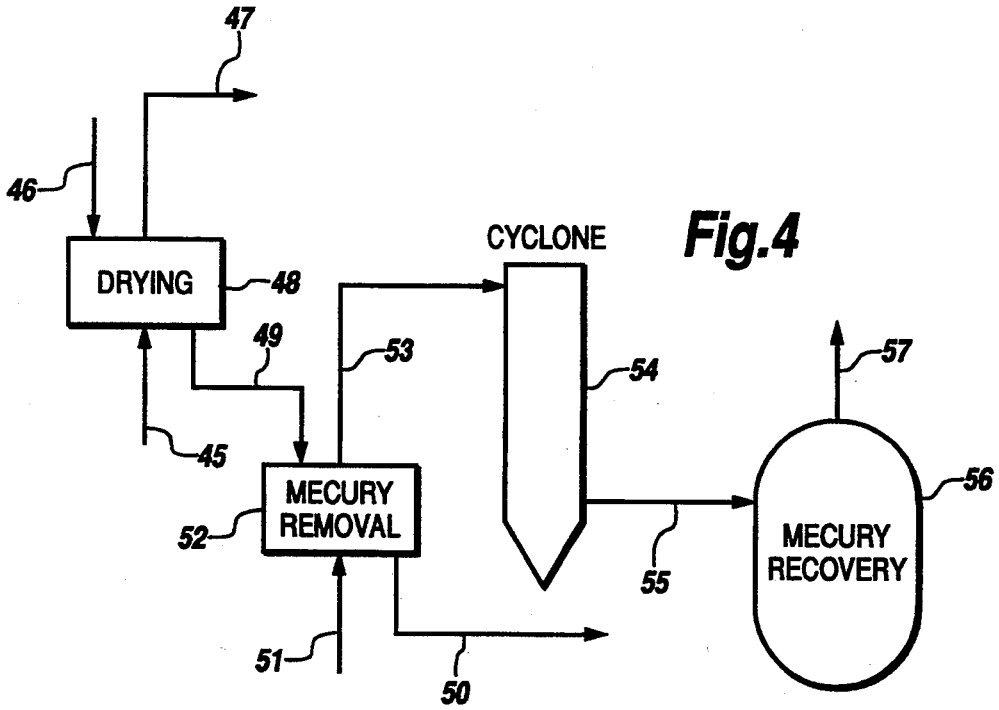
FIG. 4 shows a mercury reduction process for coal.

The process for making low mercury coal and isolating the recovered mercury is shown in FIG. 4. Crushed raw coal 46 enters a coal heater and dryer assembly 48 fed with heated drying gas 45 which could be selected from a wide variety of gases comprising combustion gas, recycled fines-free dryer exit gas, carbon dioxide, pyrolysis gas, steam, and combinations thereof. Although it is optional to dry the coal before mercury removal, it is usually easier to handle mercury recovery without the presence of large amounts of water. The coal 49 leaving said dryer has been kept under about 300° F. as it enters the mercury removal system 52 which is fed with hot gas, serving as a purge gas, 51 which preferably is substantially inert to mercury. The hot gas 51 comprises sulfur-free combustion gas, recycled fines-free dryer exit gas, carbon dioxide, pyrolysis gas, natural gas, air, steam, and combinations thereof. Operating conditions for this mercury removal system must bring the coal up to near a maximum temperature of about 550° F., preferably about 500° F., as it leaves as low-mercury coal 50 ready for further processing. The overhead isolated gas stream 53 contains vaporized mercury in an unknown form and enters a cyclone and filter system 54. It then passes to the mercury removal unit 56 which produces substantially mercury-free vent gas 57 and isolates the recovered mercury. This mercury removal unit is largely conventional and can comprise a liquid absorption system, an activated carbon adsorption system, a treated zeolite absorption system, or other equivalents. For this system it is important to insure that unwanted mercury vapor condensation does not occur in lines, equipment or other components. For good economics any system employed with this mercury removal unit is recyclable and the mercury recovered in some appropriate form.

The process of collecting mercury using activated carbon adsorption represents conventional knowledge. The activate carbon is pretreated with compounds containing elements that chemically react with mercury producing a material easily adsorbed within the carbon pores. Such compounds contain sulfur, silver, gold, copper, zinc, iron, aluminum, sodium, cadmium, manganese, and combinations thereof.

The process of collecting mercury using liquid absorption is conventional. The liquid absorbent contains compounds of elements that chemically react with mercury producing either soluble or precipitate materials. Such compounds comprise elements consisting of sulfur, silver, gold, copper, zinc, iron, aluminum, cadmium, and combinations thereof.

The foregoing description of the specific embodiments will so fully reveal the general nature of the invention that others can, by applying current knowledge, readily modify and/or adapt for various applications such specific embodiments without departing from the generic concept, and therefore such adaptations or modifications are intended to be comprehended within the meaning and range of equivalents of the disclosed embodiments. It is to be understood that the phraseology or terminology herein is for the purpose of description and not of limitation.

We claim:

1. A process for producing low mercury coal comprising:

drying raw coal with heated gas, wherein said gas is selected from the group consisting of combustion gas, recycled fines-free dryer exit gas, carbon dioxide, pyrolysis gas, steam, and combinations thereof, and wherein said coal temperature is maintained below about 300° F.;

vaporizing mercury from said dried coal with a purge gas substantially inert to mercury, wherein said purge gas is selected from the group consisting of sulfur-free combustion gas, recycled fines-free dryer exit gas, carbon dioxide, pyrolysis gas, natural gas, air, steam, and combinations thereof, and wherein said coal temperature traverses a range of about 300° to 550° F.;

removing mercury from said purge gas wherein such removal is selected from the group comprising activated carbon adsorption, mercury reacting liquid absorption, condensation, and combinations thereof; and recovering said low mercury coal.

2. The process according to claim 1 wherein said activated carbon adsorption further comprises employing a chemical pretreatment wherein such chemical is selected from the group consisting of compounds containing sulfur, silver, gold, copper, zinc, iron, aluminum, cadmium, manganese, and combinations thereof.

3. The process according to claim 1 wherein said mercury reacting liquid absorption further comprises using a liquid absorber wherein such liquid contains compounds selected from the group consisting of elements sulfur, silver, gold, copper, zinc, iron, aluminum, cadmium, manganese, and combinations thereof.

4. The product produced by the process according to claim 1.

5. The process according to claim 1 wherein said removing mercury from said purge gas further comprises removal under low moisture conditions.

6. The process according to claim 1 wherein said removing mercury from said purge gas further comprises removal under low tar conditions.

* * * * *